US005797119A

United States Patent [19]

Ozawa

[11] Patent Number: 5,797,119

[45] Date of Patent: Aug. 18, 1998

[54] COMB FILTER SPEECH CODING WITH PRESELECTED EXCITATION CODE VECTORS

[75] Inventor: Kazunori Ozawa, Tokyo, Japan

[73] Assignee: NEC Corporation, Tokyo, Japan

[21] Appl. No.: 791,547

[22] Filed: Feb. 3, 1997

Related U.S. Application Data

[63] Continuation of Ser. No. 281,978, Jul. 29, 1994, abandoned.

[30] Foreign Application Priority Data

Jul. 29, 1993 [JP] Japan ..... 5-187937

[51] Int. Cl.[6] ..... G10L 3/02

[52] U.S. Cl. ..... 704/223; 704/216

[58] Field of Search ..... 395/2.26, 2.28, 395/2.29, 2.3, 2.31, 2.32, 2.17; 704/219, 217, 220, 221, 222, 223, 208, 216

[56] References Cited

U.S. PATENT DOCUMENTS

| | | | |
|---|---|---|---|
| 4,868,867 | 9/1989 | Davidson et al. | 381/36 |
| 4,907,276 | 3/1990 | Aldersberg | 381/36 |
| 5,173,941 | 12/1992 | Yip et al. | 381/36 |
| 5,208,862 | 5/1993 | Ozawa | 381/36 |
| 5,248,845 | 9/1993 | Massie et al. | 84/622 |
| 5,271,089 | 12/1993 | Ozawa | 395/2.31 |
| 5,295,224 | 3/1994 | Makamura et al. | 315/2.32 |
| 5,495,555 | 2/1996 | Swaminathan | 395/2.16 |

OTHER PUBLICATIONS

Wang et al., Improved Excitation for Phonetically-Segmented VXC Speech Coding Below 4 Kb/s, GLOBECOM '90: IEEE Global Telecommunications Conference, pp. 946–950, Dec. 2, 1990.

Miyano et al., Improved 4.8kb/s CeLP Coding Using Two-Stage Vector Quantization With Multiple Candidates (LCELP), ICASSP '92: Accoustics, Speech and Signal Processing Conference, pp. 321–324, Mar. 23, 1992.

Ozawa et al., M-LCELP Speech Coding at 4kbps, ICASSP '94: Accoustics, Speech and Signal Processing Conference, pp. 269–272, Apr. 19, 1994.

*Primary Examiner*—David R. Hudspeth
*Assistant Examiner*—Scott Richardson
*Attorney, Agent, or Firm*—Sughrue, Mion, Zinn, Macpeak & Seas, PLLC

[57] ABSTRACT

In a code excited speech encoder, an input speech signal is segmented into speech samples at first intervals and a spectral parameter is derived from the speech samples that occur at second intervals longer than the first intervals, the spectral parameter representing the characteristic spectral feature. Each speech sample is weighted with the spectral parameter for producing weighted speech samples. The pitch period of the speech signal is determined from the weighted speech samples. A predetermined number of excitation code vectors having smaller amounts of distortion are selected from excitation codebooks as candidate code vectors. The candidate vectors are comb-filtered with a delay time set equal to the pitch period. One of the filtered code vectors having a minimum distortion is selected. The selected filtered code vector is calculated for minimum distortion and, in response thereto, a gain code vector is selected from a gain codebook. Index signals representing the spectral parameter, the pitch period, the selected excitation and gain code vectors are multiplexed for transmission or storage.

27 Claims, 2 Drawing Sheets

COMB FILTER SPEECH CODING WITH PRESELECTED EXCITATION CODE VECTORS

This is a Continuation of application Ser. No. 08/281,978 filed Jul. 29, 1994 now abandoned.

RELATED APPLICATION

This application is related to co-pending U.S. patent application Ser. No. 08/184,925, Kazunori Ozawa, entitled "Voice Coder System", filed Jan. 24, 1994, and assigned to the same assignee as the present invention.

BACKGROUND OF THE INVENTION

1. Field of the Invention

The present invention relates generally to speech coding, and more specifically to an apparatus and method for a high quality speech coding at 4.8 kbps or less.

2. Description of the Related Art

Code excited linear predictive speech coding at low bit rates is described in a paper "Code Excited Linear Prediction (CELP): High-Quality Speech at Very Low Bit Rates", M. Schroeder and B. Atal, Proceedings ICASSP, pages 937 to 940, 1985, and in a paper "Improved Speech Quality and Efficient Vector Quantization in SELP", W. B. Kleijin et al., Proceedings ICASSP, pages 155 to 158, 1988. According to this coding technique, a speech signal is segmented into speech samples at 5-millisecond intervals. A spectral parameter that represents the spectral feature of the speech is linearly predicted from those samples that occur at 20-millisecond intervals. At 5-ms intervals, a pitch period is predicted and a residual sample is obtained from each pitch period. For each residual sample, an optimum excitation code vector is selected from excitation codebooks of predetermined random noise sequences and optimum gain is determined by the selected excitation code vector, so that the error power of the combined residual signal and a replica of the speech sample synthesized by the selected noise sequence is reduced to a minimum. Index signals representing the selected code vector and gain and spectral parameter are multiplexed for transmission or storage.

One shortcoming of the techniques described in these papers is that the quality of female speech degrades significantly due to the codebook size limited by the low coding rate. One way of solving this problem is to remove the annoying noise components from the excitation signal by the use of a comb filter. This technique is proposed in a paper "Improved Excitation for Phonetically-Segmented VXC Speech Coding Below 4 kb/s," Shihua Wang et al., Proc. GLOBECOM, pages 946 to 950, 1990. While the proposed technique improves female speech quality by preemphasizing pitch characteristics, all code vectors are comb-filtered when the adaptive codebook and excitation codebooks are searched. As a result, a large amount of computations are required. Additionally, speech quality is susceptible to bit errors that occur during the transmission or data recovering process.

SUMMARY OF THE INVENTION

It is therefore an object of the present invention to provide a low bit rate speech coding technique that allows reduction of computations associated with a comb filtering process and provides immunity to bit errors.

According to a first aspect of the present invention, an input speech signal is segmented into speech samples at first intervals and a spectral parameter is derived from the speech samples that occur at second intervals longer than the first intervals, the spectral parameter representing the characteristic spectral feature. Each speech sample is weighted with the spectral parameter for producing weighted speech samples. The pitch period of the speech signal is determined from the weighted speech samples. A predetermined number of excitation code vectors having smaller amounts of distortion are selected from excitation codebooks as candidate code vectors. The candidate vectors are comb-filtered with a delay time set equal to the pitch period. One of the filtered code vectors having a minimum distortion is selected. The selected excitation code vector is calculated for minimum distortion and, in response thereto, a gain code vector is selected from a gain codebook.

According to a second aspect of the present invention, each of the filtered excitation code vectors is calculated for minimum distortion and, in response, a gain code vector is selected from the gain code vectors stored in the gain codebook so that the selected gain code vector minimizes distortion. One of the candidate code vectors and one of the selected gain code vectors are selected so that they further minimize the distortion.

According to a third aspect of the present invention, the candidate code vectors are comb-filtered with a delay time equal to the pitch period and with a plurality of weighting functions respectively set equal to gain code vectors stored in the gain codebook and a set of filtered excitation code vectors are produced corresponding to each of the candidate code vectors. The filtered excitation code vectors of each set are calculated and, and for each of the sets, a gain code vector is selected from the gain code vectors stored in the gain codebook so that each of the selected gain code vectors minimizes distortion. One of the selected candidate code vectors is selected and one of the selected gain code vectors is selected so that the selected candidate code vector and the selected gain code vector further minimize the distortion.

BRIEF DESCRIPTION OF THE DRAWINGS

The present invention will be described in further detail with reference to the accompanying drawings, in which.

DETAILED DESCRIPTION

Figure 1:
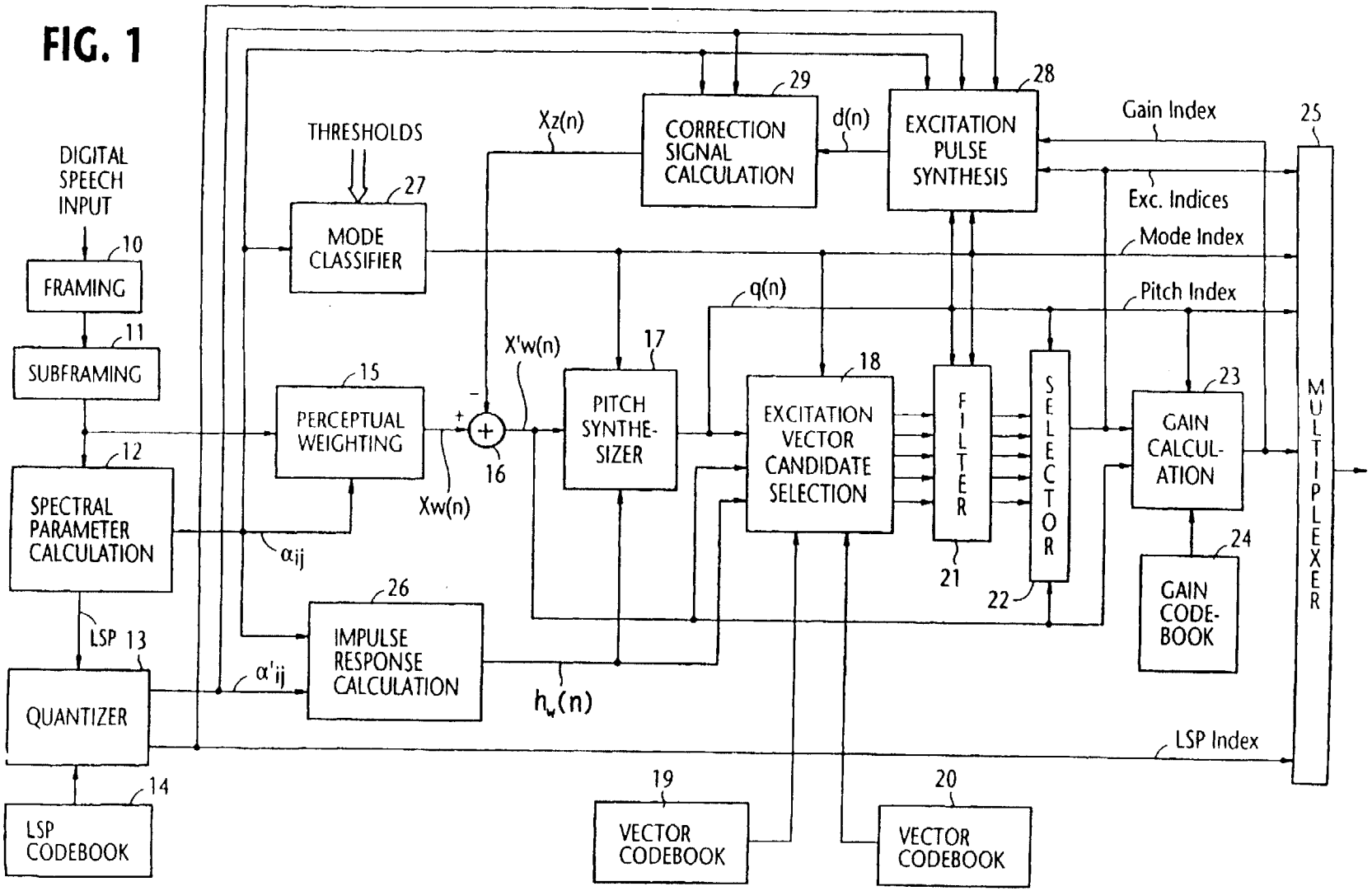
FIG. 1 is a block diagram of a speech encoder according to a first embodiment of the present invention.

In FIG. 1, there is shown a speech encoder according to a first embodiment of the present invention. The speech encoder includes a framing circuit 10 where a digital input speech signal is segmented into blocks or "frames" of 40-millisecond duration, for example. The output of framing circuit 10 is supplied to a subframing circuit 11 where the speech samples of each frame are subdivided into a plurality of subblocks, or "subframes" of 8-millisecond duration, for example.

Digital speech signals on each 8-ms subframe are supplied to a perceptual weighting circuit 15 and to a spectral parameter and LSP (SP/LSP) calculation circuit 12 where they are masked by a window of an approximately 24-millisecond length. Computations are performed on the signals extracted through the window to produce a spectral parameter of the speech samples. The number of computations corresponds to the order p (typically, p=10). Known techniques are available for this purpose, such as LPC (linear predictive coding) and the Burg's method. The latter is described in "Maximum Entropy spectrum Analysis", J. P. Burg, Ph.D. dissertation, Department of Geophysics, Stanford University, Stanford, Calif., 1975.

It is desirable to provide spectral calculations at short intervals as possible to reflect significant spectral variations that occur between consonants and vowels. For practical purposes, however, spectral parameter calculations are performed during first, third and fifth subframes in order to reduce the computations, and a linear interpolation technique is used for deriving spectral parameters for the second and fourth subframes. In the LSP calculation circuit 12, linear predictive coefficients $\alpha_i$ (where i corresponds to the order p and equals to 1, 2, . . . , 10) which are obtained by the Burg's method are converted to linear spectrum pairs, or LSP parameters suitable for quantization and interpolation processes.

The linear predictive coefficients $\alpha_{ij}$ (where j indicates subframes 1 to 5) are supplied at subframe intervals from the circuit 12 to the perceptual weighting circuit 15 so that the speech samples from the subframing circuit 11 are weighted by the linear predictive coefficients. A series of perceptually weighted digital speech samples Xw(n) are generated and supplied to a subtractor 16, in which the difference between the sample Xw(n) and a correcting signal Xz(n) from a correction signal calculator 29 is detected so that corrected speech samples X'w(n) have a minimum of error associated with the speech segmenting (blocking and sub-blocking) processes. The output of the subtractor 16 is applied to a pitch synthesizer 17 to determine its pitch period.

On the other hand, the linear spectrum pairs of the first to fifth subframes are supplied from the spectral parameter calculator 12 to an LSP quantizer 13, where the LSP parameter of the fifth subframe is vector-quantized by using an LSP codebook 14. The LSP parameters of the first to fourth subframes are recovered by interpolation between the quantized fifth-subframe LSP parameters of successive frames. Alternatively, a set of LSP vectors is selected from the LSP codebook 14 such that they minimize the quantization error, and linear interpolation is used for recovering the LSP parameters of the first to fourth subframes from the selected LSP vectors. Further, a plurality of sets of such LSP vectors may be selected from the codebook 14 as candidates which are then evaluated in terms of cumulative distortion. Selection is made on one of the candidates having a minimum distortion.

At subframe intervals, linear predictive coefficients $\alpha'_{ij}$ are derived by the LSP quantizer 13 from the recovered LSP parameters of the first to fourth subframes as well as from the LSP parameter of the fifth subframe. The coefficients are supplied to an impulse response calculator 26, and an LSP index representing the LSP vector of the quantized LSP parameter of the fifth subframe is generated and presented to a multiplexer 25 for transmission or storage.

Using the linear predictive coefficients $\alpha_{ij}$ and $\alpha'_{ij}$, the impulse response calculator 26 calculates the impulse responses $h_w(n)$ of the weighting filter of an excitation pulse synthesizer 28. The z-transform of the weighting filter is represented by the following Equation.

$$Hw(z) = \left[ 1 - \sum_{i=1}^{10} \alpha_i z^{-i} / 1 - \sum_{i=1}^{10} \alpha_i \gamma^i z^{-i} \right] \left[ 1 / 1 - \sum_{i=1}^{10} \alpha'_i \gamma^i z^{-i} \right] \quad (1)$$

where $\gamma$ is a weight constant. The output of impulse response calculator 26 is supplied to the pitch synthesizer 17 to allow it to determine the pitch period of the speech signal.

A mode classifier 27 is connected to the spectral parameter calculator 12 to evaluate the linear predictive coefficients $\alpha_{ij}$. Specifically, it calculates K-parameters that represent the spectral envelope of the speech samples of every five subframes. A technique described in a paper "Quantization Properties of Transmission Parameters in Linear Predictive Systems", John Makhoul et al., IEEE Transactions ASSP, pages 309 to 321, 1983, is available for this purpose. Using the K-parameters, the mode classifier determines an accumulated predictive error power for every five subframes compares it with three threshold values and The the error power is classified into one of four distinct categories, or modes, with a mode 0 corresponding to the minimum error power and a mode 3 corresponding to the maximum. A mode index is supplied from the mode classifier to the pitch synthesizer 17 and to the multiplexer 25 for transmission or storage.

In order to determine the pitch period at subframe intervals, the pitch synthesizer 17 is provided with a known adaptive codebook. During mode 1, 2 or 3, a pitch period is derived from an output sample X'w(n) of subtractor 16 using the impulse response $h_w(n)$ from impulse response calculator 26. Pitch synthesizer 17 supplies a pitch index indicating the pitch period to an excitation vector candidate selector 18, a comb filter 21, a vector selector 22, an excitation pulse synthesizer 28 and to the multiplexer 25. When the encoder is in mode 0, the pitch synthesizer produces no pitch index.

Excitation vector candidate selector 18 is connected to excitation vector codebooks 19 and 20 to search for excitation vector candidates and to select excitation code vectors such that those having smaller amounts of distortion are selected with higher priorities. When the encoder is in mode 1, 2 or 3, it makes a search through the codebooks 19 and 20 for excitation code vectors that minimize the amount of distortion represented by the following Equation:

$$D = \sum_{n=0}^{N-1} [X'w(n) - \beta \cdot q(n) - g_1 \cdot c_{1j}(n) * h_w(n) - g_2 \cdot c_{2i}(n) * h_w(n)]^2 \quad (2)$$

where, the symbol * denotes convolution, $\beta$ is the gain of the pitch synthesizer 17, g(n) is the pitch index, $g_1$ and $g_2$ are optimum gains of the first and second excitation vector stages, respectively, and $c_1$ and $c_2$ are the excitation code vectors of the first and second stages, respectively. When the encoder is in mode 0 in which the pitch synthesizer 17 is producing no outputs, the following Equation is used instead:

$$D = \sum_{n=0}^{N-1} [X'w(n) - g_1 \cdot c_{1j}(n) * h_w(n) - g_2 \cdot c_{2i}(n) * h_w(n)]^2 \quad (3)$$

The computations are repeated a number of times corresponding to the order p to produce M (=10) candidates for each codebook. A further search is then made for M×M candidates to determine excitation vector candidates corresponding in number to the first to fifth subframes. Details of the codebooks 19 and 20 and the method of excitation vector search are described in Japanese Provisional Patent Publication (Tokkaihei 4) 92-36170.

The excitation vector candidates, the pitch index and the mode index are applied to the comb filter 21 in which its delay time T is set equal to the pitch period. During mode 1, 2 or 3, each of the excitation code vector candidates is passed through the comb filter so that, if the order of the filter is 1, the following excitation code vector $C_{jc}(n)$ is produced as a comb filter output:

$$C_{jc}(n) = C_j(n) + \rho C_j(n-T) \quad (4)$$

where $C_j(n)$ is the excitation code vector candidate j, and $\rho$ is the weighting function of the comb filter. Alternatively, a different value of weighting function ρ may be used for each mode of operation.

Preferably, comb filter 21 is of moving average type to take advantage of this filter's ability to prevent errors that occur during transmission or data recovery process from being accumulated over time. As a result, the transmitted or stored speech samples are less susceptible to bit errors.

The filtered vector candidates $C_{jz}(n)$, the pitch index and the output of subtractor 16 are applied to the vector selector 22. For the first and second excitation vector stages (corresponding respectively to codebooks 19 and 20), the vector selector 22 selects those of the filtered candidates which minimizes the distortion given by the following Equation:

$$D_c = \sum_{n=c}^{N-1} [Xw(n) - \beta \cdot q(n) - g_1 c_{1jz}(n) * h_w(n) - g_2 c_{2kz}(n) * h_w(n)]^2 \quad (5)$$

and generates excitation indices $I_{c1}$ and $I_{c2}$, respectively indicating the selected excitation code vectors. These excitation indices are supplied to an excitation pulse synthesizer 28 as well as to the multiplexer 25.

The output of the vector selector 22, the pitch index from pitch synthesizer 17 and the output of subtractor 16 are coupled to a gain search are known in the art the gain calculator 23 searches the codebook 24 for a gain code vector that minimizes distortion represented by the following Equation:

$$D_k = \sum_{n=c}^{N-1} [Xw(n) - \beta'_k \cdot q(n) - g'_{1k} c_{1jz}(n) * h_w(n) - g'_{2k} c_{2kz}(n) * h_w(n)]^2 \quad (6)$$

where, $\beta'_k$ is the gain of k-th adaptive code vector, and $g'_{1k}$ and $g'_{2k}$ are the gains of k-th excitation code vectors of the first and second excitation vector stages, respectively. During mode 0, the following Equation is used to search for an optimum gain code vector:

$$D_k = \sum_{n=c}^{N-1} [Xw(n) - g'_{1k} c_{1jz}(n) * h_w(n) - g'_{2k} c_{2kz}(n) * h_w(n)]^2 \quad (7)$$

In each operating mode, the gain calculator generates a gain index representing the quantized optimum gain code vector for application to the excitation pulse synthesizer 28 as well as to the multiplexer 25 for transmission or storage.

Excitation pulse synthesizer 28 receives the gain index, excitation indices, mode index and pitch index and reads corresponding vectors from codebooks, not shown. During mode 1, 2 or 3, it synthesizes an excitation pulse v(n) by solving the following Equation:

$$v(n) = \beta'_k \cdot q(n) + g'_{1k} c_{1jz}(n) + g'_{2k} c_{2kz}(n) \quad (8)$$

or solving the following Equation during mode 0:

$$v(n) = g'_{1k}\, c_{1jz}(n) + g'_{2k}\, c_{2kz}(n) \quad (9)$$

At subframe intervals, excitation pulse synthesizer 28 responds to the spectral parameters $\alpha_{ij}$ and $\alpha'_{ij}$ and LSP index by calculating the following Equation to modify the excitation pulse v(n):

$$d(n) = v(n) - \sum_{l=1}^{10} \alpha_i \cdot q(n-l) + \sum_{l=1}^{10} \alpha_i \cdot g^i \cdot p(n-i) + \sum_{i=1}^{10} \alpha'_i \cdot g^i \cdot d(n-i) \quad (10)$$

where p(n) is the output of the weighting filter of the excitation pulse synthesizer.

The excitation pulse d(n) is applied to the correction signal calculator 29, which derives the correcting signal Xz(n) at subframe intervals by solving the following Equation by setting d(n) to zero if the term (n−1) of the Equation (10) is zero or positive and using d(n) if the term (n−1) is negative:

$$X_z(n) = d(n) - \sum_{i=1}^{10} \alpha_i \cdot d(n-1) + \sum_{i=1}^{10} \alpha_i \cdot g^i \cdot p(n-1) + \sum_{i=1}^{10} \alpha'_i \cdot g^i \cdot Xz(n-1) \quad (11)$$

Since the excitation code vector candidates are selected in number corresponding to the subframes and filtered through the moving average type comb filter 21, and one of the candidates is selected so that speech distortion is minimized, computations involved in the gain calculation, excitation pulse syntheses and impulse response calculation on excitation pulses are reduced significantly, while retaining the required quality of speech at 4.8 kbps or lower.

Figure 2:
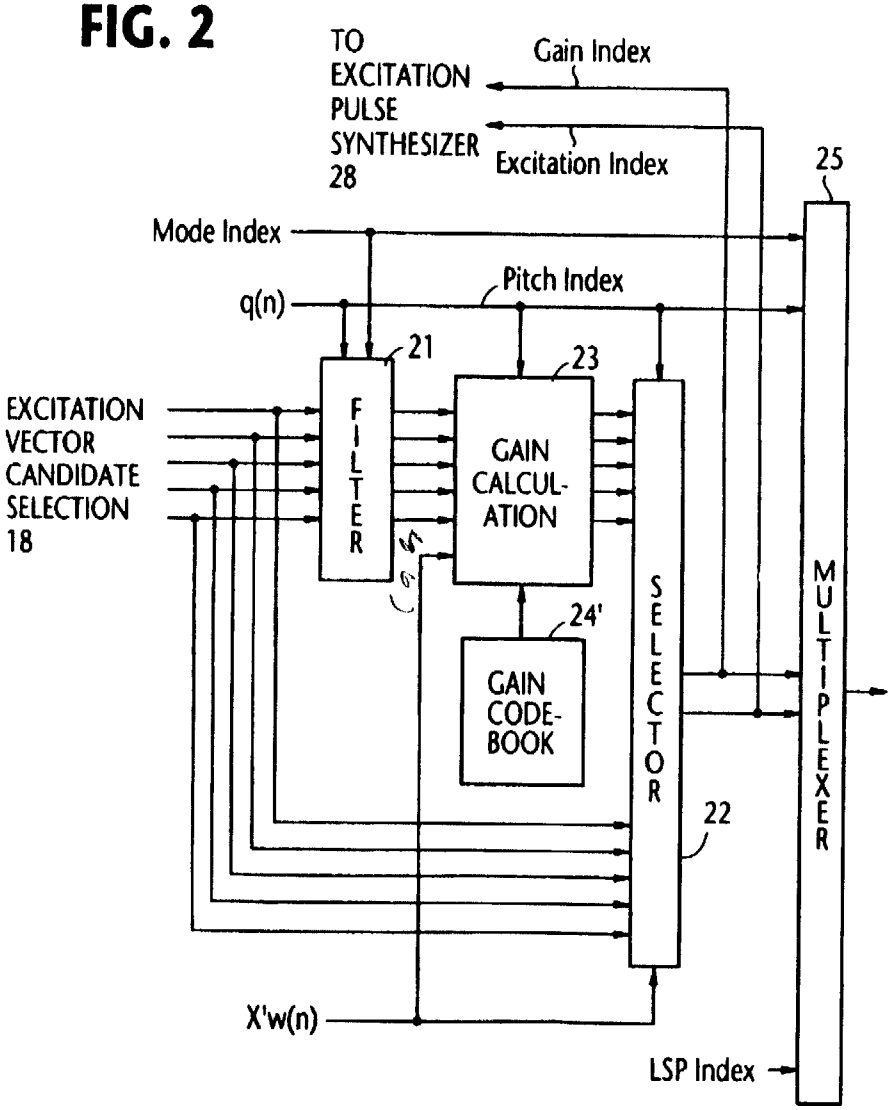
FIG. 2 is a block diagram of a speech encoder according to a second embodiment of the present invention.

A modified embodiment of the present invention is shown in FIG. 2 in which the vector selector 22 is connected between the gain calculator 23 and multiplexer 25 to receive its inputs from the outputs of gain calculator 23 and from the outputs of excitation vector candidate selector 18. The vector selector 22 receives its inputs direct from filter 21. Gain calculator 23 makes a search for a gain code vector using a three-dimensional gain codebook 24'0. During mode 1, 2 or 3, vector selector 22 searches for a gain code vector that minimizes Equation (6) with a respect to each of the filtered excitation code vectors, and during mode 0 it searches for one that minimizes Equation (7) with respect to each excitation code vector. Vector selector 22 selects one of the candidate code vectors and one of the gain code vectors that minimize the distortion given Equation (6) during mode 1, 2 or 3, or minimize the distortion given by Equation (7) during mode 0, and delivers the selected candidate excitation code vector and the selected gain code vector as excitation and gain indices to multiplexer 25 as well as to excitation pulse synthesizer 28.

Figure 3:
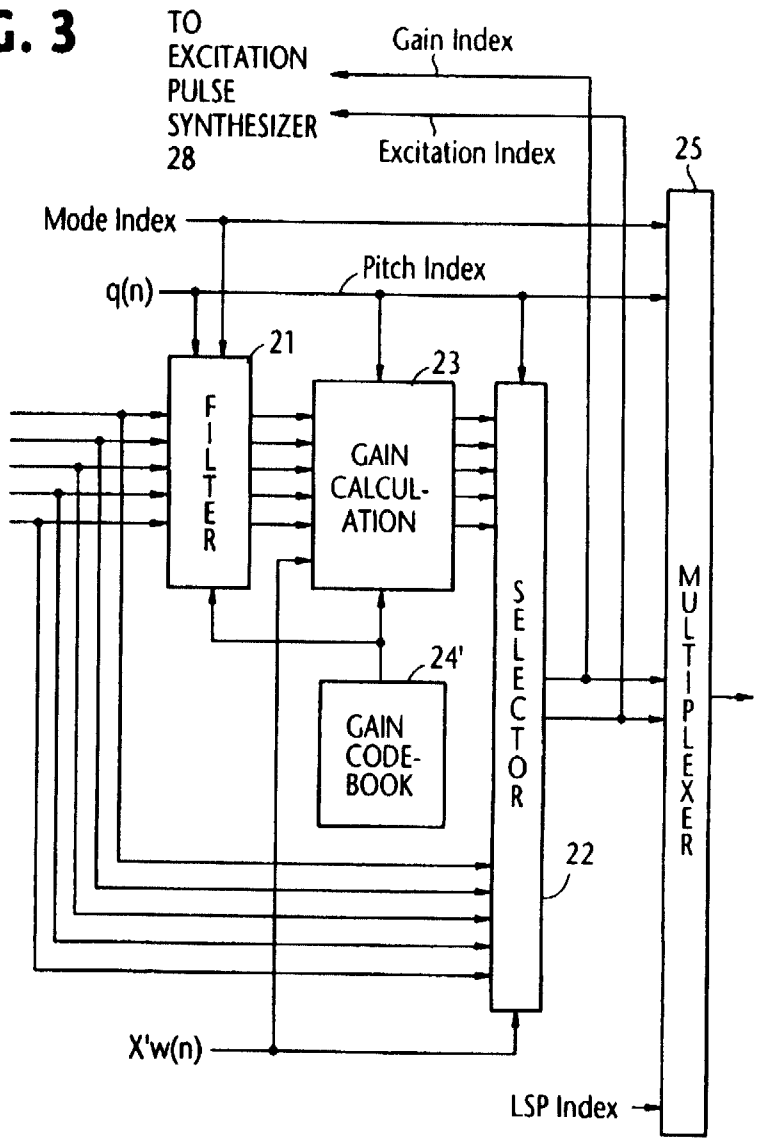
FIG. 3 is a block diagram of a speech encoder according to a third embodiment of the present invention.

A modification shown in FIG. 3 differs from the embodiment of FIG. 2 in that the weighting function η of the comb filter 21 is set equal to ε×G where ε is a constant and G represents the gain code vector. Comb filter 21 reads all gain code vectors from gain codebook 24' and substitutes each of these gain code vectors for the value G. The weighting function η is therefore varied with the gain code vectors and the comb filter 21 produces, for each of its inputs, a plurality of filtered excitation code vectors corresponding in number to the number of gain code vectors stored in gain codebook 24'. For each of its inputs, gain calculator 23 selects one of gain code vectors stored in gain codebook 24' that minimizes the distortion given by Equations (6) and (7) and applies the selected gain code vectors to vector selector 22. From these gain code vectors and the candidate excitation code vectors, vector selector 22 selects a set of a gain code vector and an excitation code vector that minimize the distortion represented by Equations (6) and (7).

What is claimed is:

1. A speech encoder comprising:

means for segmenting an input speech signal having a characteristic spectral feature into speech samples at first intervals;

means for deriving a spectral parameter from said speech samples at second intervals longer than said first intervals, and wherein said spectral parameter represents said characteristic spectral feature;

means for weighting each of said speech samples with said spectral parameter for producing weighted speech samples;

means for determining a pitch period of said speech signal from said weighted speech samples;

excitation codebook means for storing excitation code vectors;

first selector means for selecting a predetermined number of excitation code vectors having smaller amounts of distortion, relative to other code vectors, as candidate code vectors from said excitation codebook means according to said pitch period;

a comb filter for filtering said candidate code vectors, said comb filter having a delay time set equal to said pitch period;

second selector means for selecting one of said comb filtered excitation code vectors so that the selected excitation code vector minimizes distortion;

gain codebook means having a plurality of gain code vectors; and gain calculator means, responsive to the comb filtered excitation code vector selected by the second selector means, for selecting one of said gain code vectors from said gain codebook means so that the selected gain code vector further minimizes distortion.

2. A speech encoder as claimed in claim 1, wherein said comb filter is a moving average comb filter.

3. A speech encoder as claimed in claim 1, further comprising a multiplexer for multiplexing signals representative of said spectra parameter, said pitch period, said selected excitation code vector and said selected gain code vector, respectively, into a composite signal.

4. A speech encoder comprising:

means for segmenting an input speech signal having a characteristic spectral feature into speech samples at first intervals;

means for deriving a spectral parameter from said speech samples at second intervals longer than said first intervals, and wherein said spectral parameter represents said characteristic spectral feature;

means for weighting each of said speech samples with said spectral parameter for producing weighted speech samples;

means for determining a pitch period of said speech signal from said weighted speech samples;

excitation codebook means for storing excitation code vectors;

first selector means for selecting a predetermined number of excitation code vectors having smaller amounts of distortion, relative to other code vectors, as candidate vectors from said excitation codebook means according to said pitch period;

a comb filter for filtering said candidate code vectors and for producing comb filtered code vectors, said comb filter having a delay time set equal to said pitch period;

gain codebook means having a plurality of gain code vectors;

gain calculator means, responsive to each of the comb filtered excitation code vectors selected for minimum distortion, for selecting a gain code vectors corresponding to each of the comb filtered excitation code vector from said gain codebook means so that the selected gain code vector minimizes distortion; and second selector means for selecting one of said candidate code vectors from the first selector means and selecting one of the gain code vectors selected by the gain calculator means so that the selected candidate code vector and the selected gain code vectors further minimize distortion.

5. A speech encoder as claimed in claim 4, wherein said comb filter is a moving average comb filter.

6. A speech encoder as claimed in claim 4, further comprising a multiplexer for multiplexing signals representative of said spectra parameter, said pitch period, said selected excitation code vector and said selected gain code vector, respectively, into a composite signal.

7. A speech encoder comprising:

means for segmenting an input speech signal having a characteristic spectral feature into speech samples at first intervals;

means for deriving a spectral parameter from said speech samples at second intervals longer than said first intervals, and wherein said spectral parameter represents said characteristic spectral feature;

means for weighting each of said speech samples with said spectral parameter for producing weighted speech samples;

means for determining a pitch period of said speech signal from said weighted speech samples;

excitation codebook means having excitation code vectors;

first selector means for selecting a predetermined number of excitation code vectors having smaller amounts of distortion, relative to other code vectors, as candidate code vectors from said excitation codebook means according to said pitch period;

gain codebook means having a plurality of gain code vectors;

a comb filter for filtering said candidate code vectors with a delay time equal to said pitch period and with a plurality of weighting functions respectively set equal to gain code vectors stored in said gain codebook means and for producing a plurality of sets of filtered excitation code vectors, said sets corresponding respectively to said candidate code vectors;

gain calculator means, responsive to the filtered excitation code vectors of each set and for selecting, for each set, a gain code vectors from the gain code vectors stored in said gain codebook means so that each of the selected gain code vectors minimizes distortion; and second selector means for selecting one of said candidate code vectors selected by the first selector means and one of the gain code vectors selected by the gain calculator means so that the selected candidate code vector and the selected gain code vector further minimize distortion.

8. A speech encoder as claimed in claim 7, wherein said comb filter is a moving average comb filter.

9. A speech encoder as claimed in claim 7, further comprising a multiplexer for multiplexing signals representative of said spectra parameter, said pitch period, said selected excitation code vector and said selected gain code vector, respectively, into a composite signal.

10. A method for encoding a speech signal, comprising the steps of:

a) segmenting an input speech signal having a characteristic spectral feature into speech samples at first intervals;

b) deriving a spectral parameter from said speech samples at second intervals longer than said first intervals, and wherein said spectral parameter represents said characteristic spectral feature;

c) weighting each of said speech samples with said spectral parameter for producing weighted speech samples;

d) determining a pitch period of said speech signal from said weighted speech samples;

e) selecting a predetermined number of excitation code vectors having smaller amounts of distortion, relative to other code vectors, as candidate code vectors according to said pitch period from a plurality of excitation codebooks, each codebook having a plurality of excitation code vectors;

f) comb filtering said candidate code vectors with a delay time equal to said pitch period;

g) selecting one of said comb filtered excitation code vectors so that the selected excitation code vector minimizes distortion; and h) calculating the selected filtered excitation code vector for minimum distortions and determining a gain code vector so that the gain code vector further minimizes distortion, using either a first equation:

$$D_k = \sum_{n=c}^{N-1} [Xw(n) - \beta'_k \cdot q(n) - g'_{1k}c_{1jz}(n) * h_w(n) - g'_{2k}c_{2iz}(n) * h_w(n)]^2$$

where $h_w(n)$ is an impulse response;

$\beta'_k$ is the gain of a k-th code vector;

q(n) is a pitch index indicating the pitch period;

$C_{1jz}$ and $C_{2jz}$ are the excitation code vectors of a first and second vector stage, respectively, or a second equation:

$$D_k = \sum_{n=c}^{N-1} [Xw(n) - g'_{1k}c_{1jz}(n) * h_w(n) - g'_{2k}c_{2iz}(n) * h_w(n)]^2.$$

11. A method as claimed in claim 10, further comprising the step of multiplexing signals representative of said spectral parameter, said pitch period, said selected excitation code vector and said selected gain code vector, respectively, into a composite signal.

12. A method for encoding a speech signal, comprising the steps of:

a) segmenting an input speech signal having a characteristic spectral feature into speech samples at first intervals;

b) deriving a spectral parameter from said speech samples at second intervals longer than said first intervals, and wherein said spectral parameter represents said characteristic spectral feature;

c) weighting each of said speech samples with said spectral parameter for producing weighted speech samples;

d) determining a pitch period of said speech signal from said weighted speech samples;

e) selecting a predetermined number of excitation code vectors having smaller amounts of distortion, relative to other code vectors, as candidate code vectors according to said pitch period from a plurality of excitation codebooks, each codebook having a plurality of excitation code vectors;

f) comb filtering said candidate code vectors with a delay time equal to said pitch period;

g) calculating each of the filtered excitation code vectors for minimum distortion and, selecting a gain code vector from a plurality of gain code vectors so that the selected gain code vector minimizes distortion; and h) selecting one of said candidate code vectors so that the selected candidate vector and the selected gain code vector further minimize distortion, using either a first equation:

$$D_k = \sum_{n=c}^{N-1} [Xw(n) - \beta'_k \cdot q(n) - g'_{1k}c_{1jz}(n) * h_w(n) - g'_{2k}c_{2iz}(n) * h_w(n)]^2$$

where $h_w(n)$ is an impulse response;

$\beta'_k$ is the gain of a k-th code vector;

q(n) is a pitch index indicating the pitch period;

$C_{1jz}$ and $C_{2jz}$ are the excitation code vectors of a first and second vector stage, respectively, or a second equation;

$$D_k = \sum_{n=c}^{N-1} [Xw(n) - g'_{1k}c_{1jz}(n) * h_w(n) - g'_{2k}c_{2iz}(n) * h_w(n)]^2.$$

13. A method as claimed in claim 12, further comprising the step of multiplexing signals representative of said spectral parameter, said pitch period, said selected excitation code vector and said selected gain code vector, respectively, into a composite signal.

14. A method for encoding a speech signal, comprising the steps of:

a) segmenting an input speech signal having a characteristic spectral feature into speech samples at first intervals;

b) deriving a spectral parameter from said speech samples at intervals longer than said first intervals, and wherein said spectral parameter represents said characteristic spectral feature;

c) weighting each of said speech samples with said spectral parameter for producing weighted speech samples;

d) determining a pitch period of said speech signal from said weighted speech samples;

e) selecting a predetermined number of excitation code vectors having smaller amounts of distortion, relative to other code vectors, as candidate code vectors according to said pitch period from a plurality of excitation codebooks, each codebook having a plurality of excitation code vectors;

f) comb filtering said candidate code vectors with a delay time equal to said pitch period and with a plurality of weighting functions respectively get equal to gain code vectors stored in a gain codebook and producing a plurality of sets of filtered excitation code vectors., said sets corresponding respectively to said candidate code vectors;

g) calculating the filtered excitation code vectors of each set for minimum distortion and, selecting, for each set, a gain code vector from the gain code vectors stored in said gain codebook so that each of the selected gain code vectors minimizes distortion, using either a first equation:

$$D_k = \sum_{n=c}^{N-1} [Xw(n) - \beta'_k \cdot q(n) - g'_{1k}c_{1jz}(n) * h_w(n) - g'_{2k}c_{2iz}(n) * h_w(n)]^2$$

where $h_w(n)$ is an impulse response;

$\beta'_k$ is the gain of a k-th code vector;

g(n) is a pitch index indicating the pitch period;

$C_{1jz}$ and $C_{2jz}$ are the excitation code vectors of a first and second vector stage, respectively, or a second equation:

$$D_k = \sum_{n=c}^{N-1} [X'w(n) - g'_{1k}c_{1jz}(n) * h_w(n) - g'_{2k}c_{2iz}(n) * h_w(n)]^2; \text{ and}$$

h) selecting one of said candidate code vectors selected by the step (e) and one of the gain code vectors selected by the step (g) so that the selected candidate code vector and the selected gain code vector further minimize distortion.

15. A method as claimed in claim 14, further comprising the step of multiplexing signals representative of said spectral parameter, said pitch period, said selected excitation code vector and said selected gain code vector, respectively, into a composite signal.

16. The speech encoder of claim 1 further comprising a mode classifier means wherein said mode classifier means, responsive to results of the means for deriving a spectral parameter, produces a mode classifier signal of one of a first and second level, and said first selector means selects said excitation code vectors in accordance with a first equation when said mode classifier signal is of the first level and selects said excitation vectors in accordance with a second equation when said mode classifier signal is of the second level.

17. The speech encoder of claim 4 further comprising a mode classifier means wherein said mode classifier means, responsive to results of the means for deriving a spectral parameter, produces a mode classifier signal of one of a first and second level, and said first selector means selects said excitation code vectors in accordance with a first equation when said mode classifier signal is of the first level and selects said excitation vectors in accordance with a second equation when said mode classifier signal is of the second level.

18. The speech encoder of claim 7 further comprising a mode classifier means wherein said mode classifier means, responsive to results of the means for deriving a spectral parameter, produces a mode classifier signal of one of a first and second level, and said first selector means selects said excitation code vectors in accordance with a first equation when said mode classifier signal is of the first level and selects said excitation vectors in accordance with a second equation when said mode classifier signal is of the second level.

19. The method for encoding a speech signal according to claim 10 further comprising the step of classifying a mode signal in one of a first and second level based on results of said step for deriving a spectral parameter, and wherein in said step for selecting excitation code vectors, said selection is based on the first equation when said mode signal is said first level and said selection is based on the second equation when said mode signal is said second level.

20. The method for encoding a speech signal according to claim 12 further comprising the step of classifying a mode signal in one of a first and second level based on results of said step for deriving a spectral parameter, and wherein in said step for selecting excitation code vectors, said selection is based on the first equation when said mode signal is said first level and said selection is based on the second equation when said mode signal is said second level.

21. The method for encoding a speech signal according to claim 14 further comprising the step of classifying a mode signal in one of a first and second level based on results of said step for deriving a spectral parameter, and wherein in said step for selecting excitation code vectors, said selection is based on the first equation when said mode signal is said first level and said selection is based on the second equation when said mode signal is said second level.

22. The speech encoder of claim 16, wherein when said mode classifier signal is of the first level, said gain calculator means selects said gain code vector to minimize distortion $D_k$ according to the formula:

$$D_k = \sum_{n=c}^{N-1} [X'w(n) - \beta'_k \cdot q(n) - g'_{1k}c_{1jz}(n) * h_w(n) - g'_{2k}c_{2iz}(n) * h_w(n)]^2$$

where $h_w(n)$ is an impulse response;

$\beta'_k$ is the gain of a k-th code vector;

q(n) is a pitch index indicating the pitch period;

$C_{1jz}$ and $C_{2iz}$ are the excitation code vectors of a first and second vector stage, respectively;

$g'_{1k}$ and $g'_{2k}$ are gains of the k-th excitation code vectors of the first and second vector stages, respectively; and $X'_w(n)$ is an error-corrected sample from said weighted speech samples; and wherein when said mode classifier signal is of the second level, said gain calculator means selects said gain code vectors to minimize distortion $D_k$ according to the formula:

$$D_k = \sum_{n=c}^{N-1} [X'w(n) - g'_{1k}c_{1jz}(n) * h_w(n) - g'_{2k}c_{2iz}(n) * h_w(n)]^2.$$

23. The speech encoder of claim 17, wherein when said mode classifier signal is of the first level, said gain calculator means selects said gain code vector to minimize distortion $D_k$ according to the formula:

$$D_k = \sum_{n=c}^{N-1} [X'w(n) - \beta'_k \cdot q(n) - g'_{1k}c_{1jz}(n) * h_w(n) - g'_{2k}c_{2iz}(n) * h_w(n)]^2$$

where $h_w(n)$ is an impulse response;

$\beta'_k$ is the gain of a k-th code vector;

q(n) is a pitch index indicating the pitch period;

$C_{1jz}$ and $C_{2iz}$ are the excitation code vectors of a first and second vector stage, respectively;

$g'_{1k}$ and $g'_{2k}$ are gains of the k-th excitation code vectors of the first and second vector stages, respectively; and $X'_w(n)$ is an error-corrected sample from said weighted speech samples; and wherein when said mode classifier signal is of the second level, said gain calculator means selects said gain code vectors to minimize distortion $D_k$ according to the formula:

$$D_k = \sum_{n=c}^{N-1} [X'w(n) - g'_{1k}c_{1jz}(n) * h_w(n) - g'_{2k}c_{2iz}(n) * h_w(n)]^2.$$

24. The speech encoder of claim 18, wherein when said mode classifier signal is of the first level, said gain calculator means selects said gain code vector to minimize distortion $D_k$ according to the formula:

$$D_k = \sum_{n=c}^{N-1} |X'w(n) - \beta'_k \cdot q(n) - g'_{1k}c_{1jz}(n)*h_w(n) - g'_{2k}c_{2iz}(n)*h_w(n)|^2$$

where $h_w(n)$ is an impulse response;

$\beta'_k$ is the gain of a k-th code vector;

q(n) is a pitch index indicating the pitch period;

$C_{1j}$ and $C_{2iz}$ are the excitation code vectors of a first and second vector stage, respectively;

$g'_{1k}$ and $g'_{2k}$ are gains of the k-th excitation code vectors of the first and second vector stages, respectively; and $X'_w(n)$ is an error-corrected sample from said weighted speech samples; and wherein when said mode classifier signal is of the second level, said gain calculator means selects said gain code vectors to minimize distortion $D_k$ according to the formula:

$$D_k = \sum_{n=c}^{N-1} |X'w(n) - g'_{1k}c_{1jz}(n)*h_w(n) - g'_{2k}c_{2iz}(n)*h_w(n)|^2.$$

25. A method for encoding a speech signal according to claim 19, wherein when said mode classifier signal is of the first level, the determination to minimize distortion of said step (h) is determined according to the first equation; and wherein when said mode classifier signal is of the second level, the determination to minimize distortion in said step (h) is determined according to the second equation.

26. A method for encoding a speech signal according to claim 20, wherein when said mode classifier signal is of the first level, the determination to minimize distortion of said step (h) is determined according to the first equation; and wherein when said mode classifier signal is of the second level, the determination to minimize distortion in said step (h) is determined according to the second equation.

27. A method for encoding a speech signal according to claim 21, wherein when said mode classifier signal is of the first level, said selection in said step (h) to minimize distortion is selected according to the first equation, and wherein when said mode classifier signal is of the second level, said selection in said step (h) to minimize distortion is selected according to the second equation.

* * * * *